US006732035B2

(12) United States Patent
Miller et al.

(10) Patent No.: US 6,732,035 B2
(45) Date of Patent: May 4, 2004

(54) ADJUSTABLE PEDAL ASSEMBLY FOR A MOTOR VEHICLE WITH A SAFETY FEATURE

(75) Inventors: Timothy A Miller, Rochester, MI (US); David F Wagner, Rochester, MI (US); James L Carlson, Madison Heights, MI (US); Michael E Danna, Clinton Township, MI (US); James J Hoeffel, Lake Orion, MI (US); Gary F Kajdasz, Commerce Township, MI (US); Patrick D Dean, Armada, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/974,036

(22) Filed: Oct. 10, 2001

(65) Prior Publication Data

US 2002/0120376 A1 Aug. 29, 2002

Related U.S. Application Data

(60) Provisional application No. 60/239,370, filed on Oct. 11, 2000.

(51) Int. Cl.[7] ..... G05G 1/14

(52) U.S. Cl. ..... 701/49; 74/512

(58) Field of Search ..... 701/36, 49; 74/512, 74/560

(56) References Cited

U.S. PATENT DOCUMENTS

| | | | | |
|---|---|---|---|---|
| 4,439,158 A | | 3/1984 | Weber | |
| 4,454,497 A | | 6/1984 | Morse | |
| 4,583,071 A | | 4/1986 | Sebalos et al. | |
| 4,884,056 A | | 11/1989 | Ishizeki | |
| 5,207,451 A | * | 5/1993 | Furuse et al. | 280/775 |
| 5,231,891 A | | 8/1993 | Morita et al. | |
| 5,293,154 A | | 3/1994 | Ginzel et al. | |
| 5,327,117 A | | 7/1994 | Kohsaka | |
| 5,378,052 A | | 1/1995 | Yoshino | |
| 5,563,355 A | | 10/1996 | Pluta et al. | |
| 5,693,878 A | | 12/1997 | Giles | |
| 5,722,302 A | * | 3/1998 | Rixon et al. | 74/512 |
| 5,748,675 A | | 5/1998 | Hormel et al. | |
| 5,753,807 A | | 5/1998 | Trueman et al. | |
| 5,764,010 A | | 6/1998 | Maue et al. | |
| 5,771,752 A | | 6/1998 | Cicotte | |
| 5,819,593 A | | 10/1998 | Rixon et al. | |
| 5,848,662 A | | 12/1998 | Sakaue | |
| 5,850,177 A | | 12/1998 | Zimmerman | |
| 5,859,593 A | | 1/1999 | Takemura et al. | |
| 5,884,532 A | | 3/1999 | Rixon et al. | |
| 5,896,781 A | | 4/1999 | Müller | |
| 5,937,065 A | | 8/1999 | Simon et al. | |
| 5,937,707 A | | 8/1999 | Rixon et al. | |
| 5,964,125 A | | 10/1999 | Rixon et al. | |
| 5,974,351 A | | 10/1999 | Croft et al. | |
| 5,982,280 A | | 11/1999 | Fahrbach et al. | |
| 6,064,932 A | | 5/2000 | Francois | |
| 6,134,492 A | * | 10/2000 | Breed et al. | 701/49 |
| 6,157,321 A | | 12/2000 | Ricci | |
| 6,253,131 B1 | | 6/2001 | Quigley et al. | |
| 6,263,276 B1 | | 7/2001 | Yokoyama et al. | |
| 6,282,464 B1 | | 8/2001 | Obradovich | |
| 6,282,475 B1 | * | 8/2001 | Washington | 701/49 |

(List continued on next page.)

*Primary Examiner*—Michael J. Zanelli
(74) *Attorney, Agent, or Firm*—Edwin W. Bacon, Jr.

(57) ABSTRACT

An adjustable pedal system for a motor vehicle is presented. The system includes an adjustable pedal assembly being movable to at least two pedal positions and an adjustable pedal module, responsive to a pedal command, to control the movement of the adjustable pedal assembly. The pedal module includes a lockout module to disable the movement of the adjustable pedal assembly when a predetermined lockout condition is detected. The pedal module is interconnected through a data bus to at least one of vehicle electronic modules. The predetermined lockout condition is communicated to the adjustable pedal module over the data bus.

15 Claims, 6 Drawing Sheets

U.S. PATENT DOCUMENTS 6,282,495 B1 8/2001 Kirkhart et al.
6,285,924 B1 9/2001 Okamoto et al.
6,330,502 B1 12/2001 Cetinkunt et al.
6,352,007 B1 * 3/2002 Zhang et al. ..... 74/512
6,359,554 B1 3/2002 Skibinski et al.
6,397,132 B1 5/2002 Liu
6,450,061 B1 * 9/2002 Chapman et al. ..... 74/512

* cited by examiner

90

| INFORMATION REQUIRED | FRAME ID | SOURCE | RATE (92) | IGN ACC. (94) | IGN LOCK (96) | IGN UN-LOCK (98) | IGN RUN (100) | IGN START (102) |
|---|---|---|---|---|---|---|---|---|
| IGNITION STATUS | $5B | BCM | 1S AND ON CHANGE | ✓ | ✓ | ✓ | ✓ | ✓ |
| SPEED | $10 | SBEC | 86ms | X | X | X | ✓ | ✓ |
| PARK/NEUTRAL CRUISE ENGAGED | $35 | SBEC | 344ms AND ON CHANGE | X | X | X | ✓ | ✓ |
| PRNDL | $37 | EATX | 896MS AND ON CHANGE | X | X | ✓ | ✓ | X |
| REVERSE (FOR NON-EATX) | $54 | FCM | 2S AND ON CHANGE | X | X | X | ✓ | ✓ |

✓ = MESSAGE AVAILABLE ON BUS
X = MESSAGE NOT AVAILABLE ON BUS

Fig-5

110

| 112 | 114 | 116 | 118 | 120 | 122 | 124 | 126 |
|---|---|---|---|---|---|---|---|
| FAULT CONDITIONAL LOCKOUTS | | | | | | | |
| $5B | $10 | $25 | $37 | $54 | MANUAL PEDAL ADJUSTMENT (YES/NO) | MEMORY RECALL ADJUSTMENT (YES/NO) | COMMENT |
| NA | A | A | A | A | YES* | YES** | LOG FAULT ON $5B |
| NA | NA | NA | A | A | NO (IF OUT OF PARK/NEUTRAL) | NO | LOG FAULT ON SBEC AND $5B |
| NA | A | A | NA | A | YES* | NO | LOG FAULT ON $5B |
| NA | A | A | A | NA | YES* | YES** | LOG FAULT ON $5B AND $54 |
| NA | A | A | NA | NA | NO (IF OUT OF PARK/NEUTRAL) | NO | LOG FAULT ON $5B AND $54 |
| NA | NA | NA | A | NA | NO (IF OUT OF PARK/NEUTRAL) | NO | LOG FAULT ON $5B |
| NA | NA | NA | NA | A | NO | NO | LOG FAULT ON $5B AND SBEC |
| NA | NA | NA | NA | NA | NO | NO | LOG FAULT ON $5B IF LAST KNOW IGNITION STATUS WAS NOT IN THE LOCKED POSITION |
| RUN | A | A | A | A | YES* | YES** | NO FAULT OCCURRED |
| RUN | A | A | NA | A | YES* | NO | LOG FAULT ON $37 |
| RUN | A | A | A | NA | YES* | YES** | LOG FAULT ON $54 |
| RUN | NA | NA | A | A | NO (IF OUT OF PARK/NEUTRAL) | NO | LOG FAULT ON SBEC |
| RUN | A | A | NA | NA | NO (IF OUT OF PARK/NEUTRAL) | NO | LOG FAULT ON $37 AND $54 |
| RUN | NA | NA | A | NA | NO (IF OUT OF PARK/NEUTRAL) | NO | LOG FAULT ON SBEC AND $54 |
| RUN | NA | NA | NA | A | NO | NO | LOG FAULT ON SBEC AND $37 |
| RUN | NA | NA | NA | NA | NO | NO | LOG FAULT ON SBEC $37 AND $54 |
| START | A | A | D | A | YES* | YES** | NO FAULT HAS OCCURRED |
| START | A | A | NA | NA | NO (IF OUT OF PARK/NEUTRAL) | NO | LOG FAULT ON $54 |
| START | NA | NA | NA | A | NO | NO | LOG FAULT ON SBEC |
| START | NA | NA | NA | NA | NO | NO | LOG FAULT ON SBEC AND $54 |
| UNLOCK | D | D | A | D | YES | YES** | NO FAULT HAS OCCURRED |
| UNLOCK | D | D | NA | D | NO | NO | LOG FAULT ON $37 |
| UNLOCK | D | D | D | D | YES | YES | NO FAULT HAS OCCURRED |
| ACCESSORY | D | D | D | D | YES | YES | NO FAULT HAS OCCURRED |

NA - NOT AVAILABLE DUE TO FAULT OR NORMAL VEHICLE OPERATION
A - AVAILABLE
D - DON'T CARE
* - CRUISE AND REVERSE LOCKOUT CONDITIONS STILL APPLY
** - MEMORY RECALL ONLY WHEN IN PARK AND IF VEHICLE SPEED IS LESS THAN $15, LESS THAN 0.1 MPH MEMORY SET CAN OCCUR AT ANY TIME

Fig-6

ADJUSTABLE PEDAL ASSEMBLY FOR A MOTOR VEHICLE WITH A SAFETY FEATURE

CROSS-REFERENCE TO RELATED APPLICATIONS

This application claims the benefit of U.S. Provisional Patent Application Ser. No. 60/239,370, filed on Oct. 11, 2000.

BACKGROUND OF THE INVENTION

1. Field of the Invention

The present invention relates generally to an adjustable pedal assembly for a motor vehicle, and more particularly, to an adjustable pedal assembly that can be disabled due to J1850 messages.

2. Description of the Related Art

Motor vehicles are likely to be driven by more than one person including family vehicles and company vehicles. Even for an individual driver, vehicles are driven by different people for maintenance purposes or in case of an emergency. Most likely, different drivers have different anatomy. Thus, motor vehicles are required to have suitable adjustment features to provide desirable driving conditions for more than one driver.

Conventional vehicular pedals are foot operated by the driver. The positional relationship between a vehicle occupant and a pedal is set by adjusting the front seat. Typically, the front seat is slidably mounted on a seat track with means for securing the seat along the track in a plurality of adjustment positions. However, due to difference in anatomical dimensions, the use of front seat tracks has been a growing concern since such adjustment could not accommodate all vehicle occupants.

Several attempts have been made over many years to provide selective adjustment of the pedal system to accommodate various size drivers. Recently, a control pedal mechanism has been developed that accomplishes the pedal adjustment without altering further dimensional relationships between the driver and the pedal assembly. However, none of these developments has been adapted to take into consideration certain safety concerns.

Therefore, it would be highly desirable to provide an adjustable pedal assembly that is simple, inexpensive and easy to operate, yet capable of providing the adjustment of the pedal assembly to a desired position. It would also be highly desirable to provide an adjustable pedal assembly that can disable the adjustment of the pedal assembly under certain conditions.

SUMMARY OF THE INVENTION

An object of the present invention is provided an adjustable pedal assembly for a motor vehicle. The invention is capable of disabling the required adjustment under certain conditions while the adjustable pedal assembly is active.

To achieve this object, the present invention provides an adjustable pedal system for a motor vehicle. The adjustable pedal system includes an adjustable pedal assembly and an adjustable pedal module. The pedal assembly is movable to at least two pedal positions. The adjustable pedal module is responsive to a pedal command. The adjustable pedal module controls the movement of the adjustable pedal assembly. The pedal module further includes a lockout module to disable the movement of the adjustable pedal assembly when a predetermined lockout condition is detected. The adjustable pedal module is interconnected through a data bus to several vehicle electronic modules. The predetermined lockout condition is communicated to the adjustable pedal module over the data bus.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein:

FIG. 5 is a table describing the data bus message communication during different ignition states; and FIG. 6 is a table describing fault condition lockouts according to the presently preferred embodiment of the invention.

DETAILED DESCRIPTION OF THE PREFERRED EMBODIMENT

Figure 1:
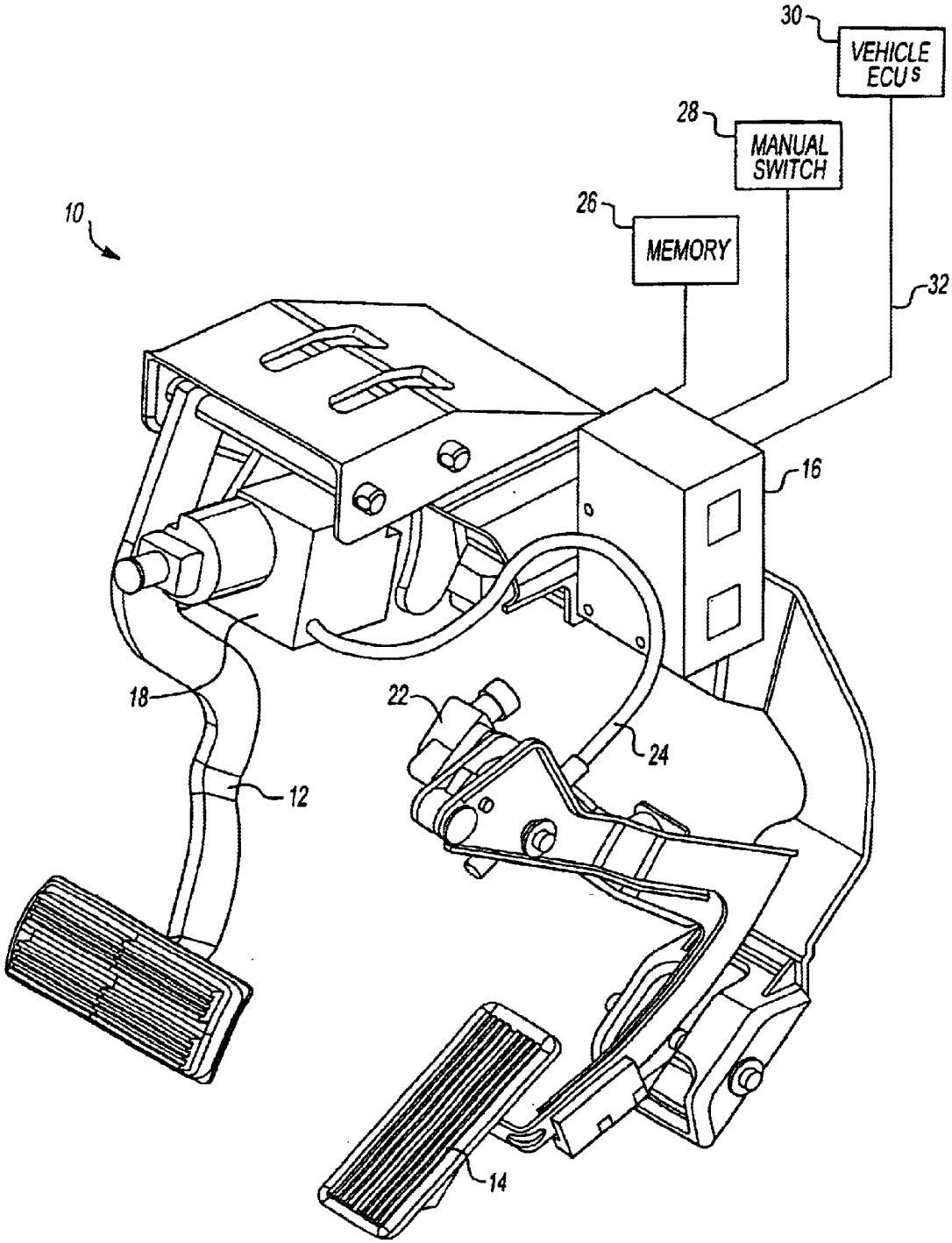
FIG. 1 is a perspective view depicting the adjustable pedal assembly system of the presently preferred embodiment of the invention.

Referring to FIG. 1, an adjustable pedal module system (APMS) 10 for a motor vehicle is illustrated in accordance with the teachings of the present invention. The APMS 10 includes a brake pedal assembly 12, an accelerator pedal assembly 14, an adjustable pedal module (APM) 16, and supporting electrical circuits (not shown). The APM 16 controls the pedal assemblies 12 and 14 and communicates with other vehicle electronic control units (ECUs) 30. The APM 16 may receive a manual interrupt input from either a manual switch 28 or from memory 26. The APM 16 is connected to the ECUs via a data bus 32. Movements of the accelerator pedal assembly 14 are monitored by a movement sensor 22. The movement sensor is connected to a motor module 18 through a cable 24. The brake pedal assembly 12 is also connected to the motor module 18.

Figure 2:
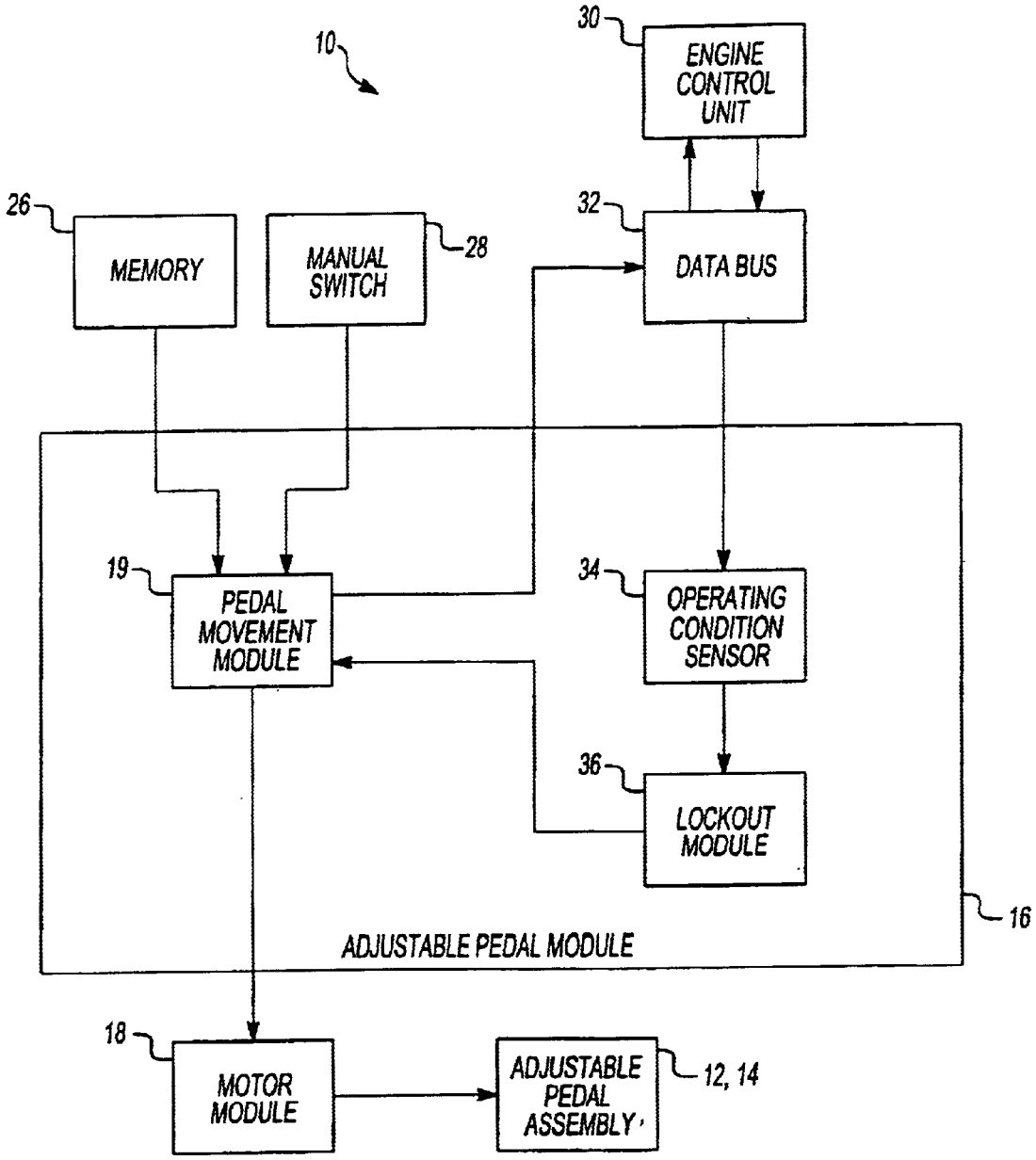
FIG. 2 is a block diagram depicting the adjustable pedal assembly system of the presently preferred embodiment of the invention.

FIG. 2 of the drawings illustrates the preferred embodiment of the APM 16 in greater detail. The APM 16 further contains a pedal movement module 19, an operating condition sensor 34, and a lockout module 36. The pedal movement module 19 receives manual interrupt inputs from the manual switch 28 and memory 26. The pedal movement module 19 communicates with the ECUs 30 through the data bus 32. The operating condition sensor 34 receives identifying messages from the various modules of the motor vehicle. The operating conditional messages are collected in the operating sensor 34 and sent to the lockout module 36.

The lockout module 36 determines the existence of any lockout conditions based upon the identifying messages received by the operating condition sensor 34. If any of lockout conditions are detected, the pedal movement module 19 of the APM 16 disables the adjustment of the pedal assemblies 12 and 14. If lockout conditions are not detected, the pedal movement module 19 adjusts the pedal assemblies 12 and 14 to a desired position.

Figure 3:
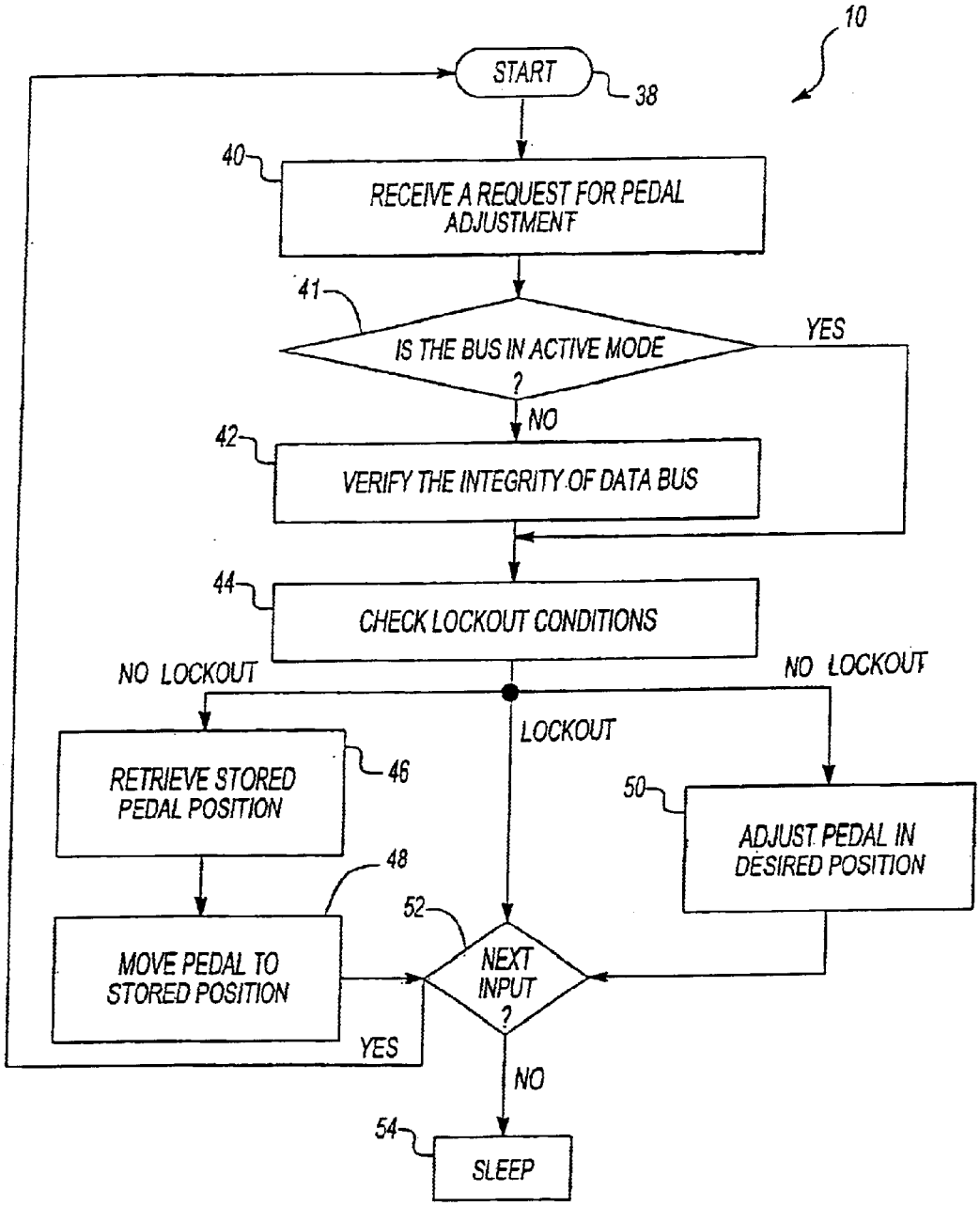
FIG. 3 is a flow chart depicting the acquisition of a required adjustment of the pedal assembly of the presently preferred embodiment of the invention.

With further reference to FIG. 3 of the drawings, a process for adjusting the pedal assemblies 12 and 14 in accordance with the teachings of the present invention is illustrated. The APMS 10 receives an input at step 40. The input signal may be from either the manual switch 28, which is pressed by a vehicle occupant, or memory 26. The memory 26 retains at least two different pedal positions. Upon a request for adjustment of the pedal assembly 12 and 14 by the vehicle occupant, the input signal is sent to the pedal movement module 19 of the APM 16.

The pedal movement module 19 of the APM 16 controls the movement of both the brake assembly 12 and the accelerator assembly 14. When the pedal movement module 19 acknowledges an input signal, the APM 16 determines whether the data bus 32 is in an active mode, step 41. If the data bus 32 is in an active mode, the APM 16 proceeds on to checking lockout conditions, step 44. On the other hand, if the data bus 32 is in an inactive mode, the integrity of data bus 32 is verified, step 42. More particularly, at step 42, the APMS 10 determines the data bus 32 is capable of providing bi-directional communication between the ECUs 30 and the APM 16. The step of verifying the integrity of data bus 32 will be described below in greater detail with reference to FIG. 4.

In the preferred embodiment, a SAE J1850 bus is used as the data bus 32 for providing bi-directional communication between the APM 16 and the ECUs 30. However, it should be understood that any data bus, such as a Controller Area Network (CAN) data bus, can also be used so long as bi-directional communication is supported between vehicle ECUs.

Once the integrity of the data bus 32 is established, other ECUs place lockout information on the bus. After the integrity of data bus 32 is verified, the APM 16 determines whether lockout conditions exist, step 44. The pedal movement module 19 interfaces with the vehicle ECUs 30 via data bus 32 in order to monitor operating conditions of the vehicle.

The signals from the ECUs 30 are transmitted to the lockout module 36. The lockout module 36 monitors the signals to determine whether any lockout conditions exist. What constitutes a lockout condition will be more fully described below with reference to FIGS. 5 and 6.

The presence of lockout conditions determines whether to adjust the pedal assemblies 12 and 14 to a desired position. If lockout conditions are detected, the APMS 10 does not adjust the pedal assemblies 12 and 14, but instead terminates the process, step 52. If no lockout conditions are found, the pedal assemblies 12 and 14 are adjusted to the desired position, step 50. If the input signal is received from the memory 26 and none of the lockout conditions are identified, the APMS 10 retrieves the desired pedal position from memory 26. Subsequently, the APMS 10 moves the pedal assemblies 12 and 14 to the stored position, step 48. At step 52, the APMS 10 waits for the next input from the vehicle occupant, and enters a sleeping mode, step 54.

Figure 4:
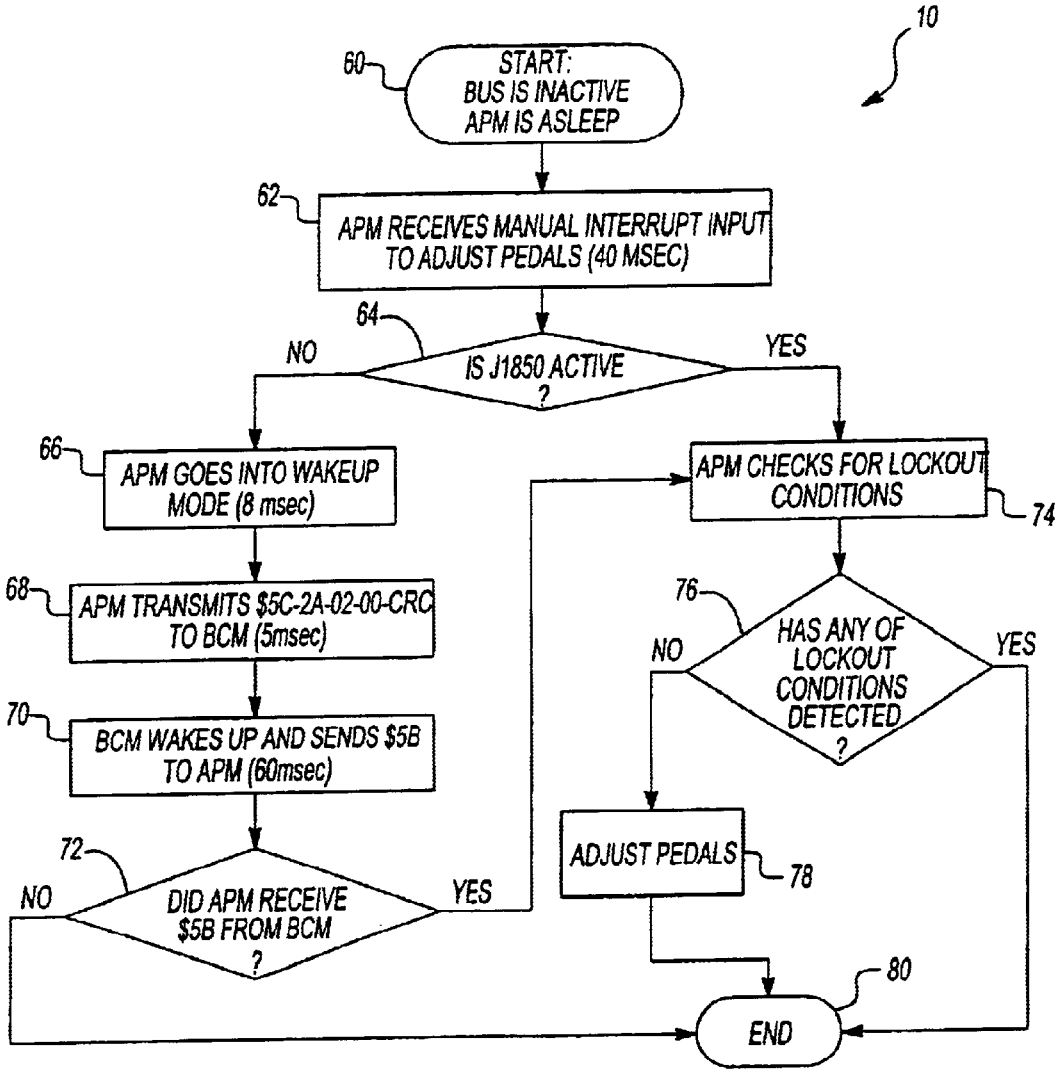
FIG. 4 is a flow chart depicting the method of verifying the integrity of data bus of the presently preferred embodiment of the invention.

With reference to FIG. 4, a more detailed flowchart of the APMS 10 is illustrated. At step 60, the data bus is in an inactive mode and the APM 16 is in a sleeping mode. As mentioned above, the APMS 10 receives a manual interrupt input signal from a manual switch 28 to adjust the pedal assemblies 12 and 14, step 62. Upon receiving the manual interrupt input signal, the APM 16 debounces and decodes the input signal. The maximum rate at which the APMS 10 receives the input signal and adjusts the pedal assemblies 12 and 14 is forty msec.

At step 64, the APMS 10 determines if the SAE J1850 data bus 32 for an active mode. If the SAE J1850 is active, the APM 16 of APMS 10 checks for lockout conditions, step 74. The following table 1 shows the lockout conditions for the APMS 10.

TABLE 1

| Vehicle conditions | Lockout |
|---|---|
| Transmission in Reverse Gear | The switches and memory recall shall lockout |
| Cruise Control engaged (speed set) | The switches and memory recall shall lockout |
| Transmission in Neutral, Drive, or Low gear | Only memory recall shall lockout |

The APMS 10 disables the adjustable pedal feature under certain conditions. In the preferred embodiment of present invention, the APMS 10 has different lockout conditions depending on the source of the manual interrupt input signal. If the input signal is from the memory 26, the APMS 10 will only adjust the pedal assemblies 12 and 14 when the transmission of vehicle is in Parking. If the input signal is from the manual switch 28, the pedal assemblies 12 and 14 are locked out only when the transmission is in Reverse or when cruise control is engaged.

In order to determine if the vehicle is under any of the lockout conditions, the pedal movement module 18 of the APM 16 monitors signals from various ECUs 30 via the SAE J1850 data bus 32. The ECUs 30 periodically transmit signals indicative of operating conditions of the vehicle. Tables 2 and 3 shows bus messages used to determine lockout conditions and a description of each bus message.

TABLE 2

| Frame ID # | Description | Source | Rate |
|---|---|---|---|
| $5B | Ignition Switch Status | Body controller module (BCM) | 1 sec. And on change |
| $10 | Engine RPM, Speed, and MAP | Engine Controller Module (SBEC/DEC) | 86 msec. |
| $35 | Misc. Engine Status | Engine Controller Module (SBEC/DEC) | 344 msec. and on change |
| $37 | PRNDL Display | Transmission Controller Module (EATX) | 896 msec. and on change |
| $54 | Warning Data | Front Control Module (FCM) | 2 sec. And on change |

TABLE 3

| Frame ID # | Description |
|---|---|
| $5B | The APM 16 shall receive the $5B bus message to detect the ignition switch bus status for logging communication faults. |
| $10 | Also, the APM 16 shall use the $10 bus message to monitor the speed during memory recall and determine if the feature needs to be locked out. |

TABLE 3-continued

| Frame ID # | Description |
|---|---|
| $35 | The APM 16 shall receive the $35 bus message to detect if the cruise control is engaged or detected if the vehicle is in Park/Neutral and determine if the feature needs to be locked out. |
| $37 | The APM 16 shall receive $37 bus message to detect if the vehicle is in Park, Reverse, Neutral, Drive, or Low Gear. |
| $54 | The APM 16 shall receive the $54 bus message to detect if the vehicle is in Reverse gear and determine if the feature needs to be locked out. |

As briefly mentioned above, the APM 16 determines if lockout conditions exist before the APM 16 adjusts the pedal assemblies 12 and 14. Frame $35 shows when cruise control is engaged or if the transmission is in Park or Neutral. The APMS 10 locks out the pedal assemblies 12 and 14 when $35 message indicates that cruise control is engaged and the vehicle transmission is in neither Park nor Neutral.

The bus message $37 indicates whether the vehicle transmission is in Park, Neutral, Drive, or Low. In bus message $37, the least three significant bits of a data byte may show if the transmission is in Reverse. The status of the vehicle transmission determines whether to lock out the pedal assemblies 12 and 14. For example, the vehicle transmission must be in Park for the pedal assemblies 12 and 14 to be adjusted when the input signal is transmitted from memory recall 26.

Bus message $37 is available only for vehicles with automatic transmissions. For vehicles with manual transmissions, bus message 37 is not available. This is because the manual transmission is not controlled by ECUs, but is controlled strictly mechanically. For vehicles with automatic transmissions, the APM 16 uses bus messages $35 and $54 to determine which gear the transmission of the vehicle is in. The bus message $35 is indicative of whether the transmission is in PARK or NEUTRAL, and the bus message $54 is used to check if the transmission is in REVERSE. Thus, the APM 16 determines whether the transmission of the vehicle is in DRIVE depending on bus messages $35 and $54 for automatic transmission vehicles only.

Referring back to FIG. 4, the APM 16 checks for lockout conditions in step 74 from operating conditions transmitted from the aforementioned bus messages. If conditional step 76 of the APMS 10 detecting any of the lockout conditions is satisfied the APMS 10 does not adjust the pedal assemblies 12 and 14, and returns to stand-by mode, step 80. If the lockout conditions are not determined the APMS 10 adjusts the pedal assemblies 12 and 14 to a desired position and returns to the stand-by mode, steps 78 and 80.

The APMS 10 will lockout manual or memory controls due to a diagnostic issues. Still with reference to FIG. 4 of the drawings, if it is determined that the J1850 data bus 32 is inactive at step 64, the APMS 10 verifies the integrity of the data bus 32. When the integrity of the data bus 32 is verified, the APMS 10 checks for an open circuit condition. For example, if an open circuit exists and the integrity of the bus 32 is not verified, the APM 16 is likely to determine that the bus is inactive, and the other modules are asleep. Operation of the APM 16 is then excluded because the data bus 32 does not respond to the lockout conditions due to an open circuit.

Therefore, in this present invention, the APMS 10 verifies the integrity of the data bus using a handshake method between two vehicle modules which are still active when the vehicle is in a key-off condition. Two vehicle modules that are still used, in an active mode to minimize the current draw from the battery. Thus, the battery size can be kept to a minimum.

If the SAE J1850 is inactive, the APM 16 wakes up in 8 msec, step 66. As the APM 16 wakes up, it transmits the $5C-2A-02-00-CRC message to the Body Control Module (BCM), step 68. The $5C-2A-02-00-CRC is a motion status message used by the memory system, that is indicative of whether or not the APM 16 is manually performing an adjustment. In the presently preferred embodiment, BCM is used for the handshake method. However, it would be understood that any vehicle module that is still active in key-off condition could also be used.

The BCM has been in an inactive mode until it receives $5C-2A-02-00-CRC bus message from the APM 16. As shown in step 70, when the BCM receives a signal, the BCM is activated sending $5B bus message back to the APM 16 in 60 msec. Within 25 msec., the APM 16 must receive the $5B bus message in order to verify the integrity of the SAE J1850 32 bus.

As indicated in Tables 2 and 3, the $5B bus message is indicative of the ignition status. If APM 16 receives $5B from the BCM within 60 msec., the AMP 16 confirms that the SAE J1850 data bus 32 is capable of receiving and transmitting data signals. If the APM 16 does not receive the $5B bus message within 90 msec. after transmitting $5C bus message, then the APM 16 returns to sleep mode and tries again with the next activation of a manual switch.

$5B bus message indicates whether the ignition state is in RUN mode. In RUN mode, the APM 16 retrieves the SAE J1850 bus 32. The APM 16 logs a fault when the APM 16 does not receive a needed bus message within a maximum period of 5 seconds. Therefore, by monitoring the ignition status, the APM 16 determines which lockout conditions are relevant before adjusting the pedal assemblies 12 and 14.

FIG. 5 is a table 90 depicting the bus messages and transmission rates 92 for different ignition states. The different ignition states are accessory-mode 94, lock-mode 96, unlock-mode 98, run-mode 100 and start-mode 102. All of the bus messages are available when the ignition state is in run-mode 100. The PRNDL bus message is available when the ignition state is in unlock-mode 98. The APMS 10 can adjust the pedal assemblies 12 and 14 if the input signal comes from the memory 26 during unlock mode 98. Also, $37 message is not available when the ignition state is in start-mode 102. This is because $37 message is generated by the transmission module such as EATX that is asleep in the ignition start mode. Bus message $37 is, thus, generated only when the associated transmission module is awake.

FIG. 6 shows fault lockout conditions 110 to disable the APM 16 when at least one of the bus messages $5B 112, $10 114, $35 116, $37 118 and $54 120 is missing. Comments 126 show where the log fault is located when one or more bus messages are missing. Whether to disable the APM 16 when at least one of the bus messages is missing also depends on whether the input signal comes from the manual switch 28 or the memory 26. Manual pedal adjustment 122 and memory recall adjustment 124 columns show if the pedal assemblies 12 and 14 are adjusted when various faults are present.

The APMS 10 controls the movement of the brake 12 and accelerator 14 pedal assemblies through a full range of adjustment as selected by the vehicle occupant. The pedal assemblies 12 and 14 can be adjusted in the range of 80 mm from the nominal position (fully forward position) by the use of a manual switch. The pedal assembly 12 and 14 adjust at a speed of 11.5 mm/sec under nominal conditions of 13.5 volts and 25° C. The APMS 10 has at least two positions stored in memory 26 for the purpose of the vehicle occupant's personalization.

Those skilled in the art can now appreciate from the foregoing description that the broad teachings of the present invention can be implemented in a variety of ways. Therefore, while this invention has been described in connection with particular examples thereof, the true scope of the invention should not be so limited since other modifications will become apparent to the skilled practitioner upon a study of the drawings, specifications and following claims.

What is claimed is:

1. An adjustable pedal system for a motor vehicle, comprising:

an adjustable pedal assembly being movable to at least two pedal positions;

an adjustable pedal module, responsive to a pedal command, to control the movement of the adjustable pedal assembly, the pedal module including a lockout module to disable the movement of the adjustable pedal assembly when a predetermined lockout condition is detected; and a data bus interconnecting at least one vehicle ECU and the adjustable pedal module, said adjustable pedal module verifying the integrity of said data bus, movement of the adjustable pedal assembly being allowed only after the data bus is verified;

wherein the predetermined lockout condition is communicated to the adjustable pedal module over the data bus.

2. The adjustable pedal system of claim 1 wherein the data bus is a J1850 data bus.

3. The adjustable pedal system of claim 1 wherein the pedal command is a stored input.

4. The adjustable pedal system of claim 3 wherein the pedal module is interconnected through a data bus to at least one vehicle electronics module; and wherein the pedal command is a pedal movement message communicated from a vehicle ECU.

5. The adjustable pedal system of claim 4 wherein the predetermined lockout condition is selected from the group comprising: the vehicle is in reverse gear, the vehicle cruise control is engaged, the vehicle is in neutral gear, the vehicle is in drive, and the vehicle is in low gear.

6. The adjustable pedal system of claim 5 wherein the data bus is a J1850 data bus.

7. The adjustable pedal system of claim 5 wherein a vehicle operating condition is monitored to detect the predetermined lockout condition.

8. An adjustable pedal system for a motor vehicle, comprising:

an adjustable pedal assembly being movable to a desired position;

an adjustable pedal module, responsive to a pedal command from a manual input, to control the movement of the adjustable pedal assembly, the pedal module including a lockout module to disable the movement of the adjustable pedal assembly when a predetermined lockout condition is detected, the adjustable pedal module being interconnected through a data bus to at least one vehicle ECU, the adjustable pedal module verifying the integrity of the data bus and preventing movement of the adjustable pedal assembly when the integrity of the data bus is unverified; and wherein the predetermined lockout condition is communicated to the adjustable pedal module over the data bus.

9. The adjustable pedal system of claim 8, wherein the data bus is a J1850 data bus.

10. The adjustable pedal system of claim 8, wherein the predetermined lockout condition is selected from the group comprising: the vehicle is in reverse gear, and the vehicle cruise control is engaged.

11. The adjustable pedal system of claim 8, wherein a vehicle operating condition is monitored to detect the predetermined lockout condition.

12. An adjustable pedal system for a motor vehicle, comprising:

an adjustable pedal assembly being movable to at least two pedal positions;

an adjustable pedal module, responsive to a pedal command from a stored input, to control the movement of the adjustable pedal assembly, the pedal module including a lockout module to disable the movement of the adjustable pedal assembly when an unverified data bus is detected; and the data bus interconnecting the adjustable pedal module to at least one vehicle electronics module, the adjustable pedal module verifying the integrity of the data bus;

wherein the pedal command is a pedal movement message communicated from the at least one vehicle electronic module over the data bus.

13. The adjustable pedal system of claim 12, wherein the lockout module further disables movement of the adjustable pedal assembly based on a predetermined lockout condition selected from the group consisting of: the vehicle is in reverse gear, the vehicle cruise control is engaged, the vehicle is in neutral gear, the vehicle is in drive, and the vehicle is in low gear.

14. The adjustable pedal system of claim 13, wherein a vehicle operating condition is monitored to detect the predetermined lockout condition.

15. The adjustable pedal system of claim 12, wherein the data bus is a J1850 data bus.

* * * * *